US006036311A

United States Patent [19]

Friedman

[11] Patent Number: 6,036,311

[45] Date of Patent: Mar. 14, 2000

[54] SELF-SERVICE DISPLAY RACK FOR CLIP-ON SUNGLASSES

[76] Inventor: Dean Friedman, 61 Ulster Ave., Atlantic Beach, N.Y. 11509

[21] Appl. No.: 09/312,829

[22] Filed: May 17, 1999

[51] Int. Cl.[7] ..... G02C 1/00

[52] U.S. Cl. ..... 351/158; 428/902

[58] Field of Search ..... 351/158, 41; 206/5; 248/902, 809.1

[56] References Cited

U.S. PATENT DOCUMENTS

| | | | |
|---|---|---|---|
| D. 350,359 | 9/1994 | Friedman . | |
| 3,891,092 | 6/1975 | Surrette et al. | 428/902 |
| 5,164,749 | 11/1992 | Shelton . | |

*Primary Examiner*—Hung Xuan Dang
*Attorney, Agent, or Firm*—James & Franklin, LLP; Robert L. Epstein; Harold James

[57] ABSTRACT

Each side of the multi-sided freestanding rotable rack includes a first section, with a first indicia representing a particular eyeglass frame style, and a plurality of second sections. Each of the second sections includes a second indicia representing a different sunglass lens type suitable for a particular activity. A retainer for clip-on sunglasses extends from each of the second sections. The retainer holds clip-on sunglasses suitable for the eyeglass frame style indicated by the first indicia of the side upon which it is located and for use in the activity represented by the second indicia associated with the second section upon which it is located.

4 Claims, 2 Drawing Sheets

SELF-SERVICE DISPLAY RACK FOR CLIP-ON SUNGLASSES

The present invention relates to a point of sale display rack for clip-on sunglasses and more particularly to rack for displaying clip-on sunglasses with a variety of different lens types for use with eyeglasses of several different frame styles.

Clip-on sunglasses are known in the art, see U.S. Pat. No. 5,164,749 issued Nov. 17, 1992 to Robert Shelton and U.S. Design Pat. No. Des 350,359 issued Sep. 16, 1994 to Sidney Friedman. These sunglasses consist of two light attenuating lenses retained on a bridge element to which is mounted a spring loaded clip. The clip is designed to removeably affix the bridge element and lenses to the frame of a pair of eyeglasses.

Clip-on sunglasses have become more specialized, containing lenses with different optical characteristics for different activities. For example, some clip-ons are provided with lenses fabricated to optimize the attenuation of the glare from water and hence are best for water sports. Others are fabricated to attenuate glare from the road most effectively and therefore are best for driving. Still others may be formulated for land sports or fashion wear.

Further, there are several basic eyeglass frame styles available, such as round, square, rectangular, aviator, oval and the like. Furnishing clip-on sunglasses with lenses suitable for different activities, capable of use with each frame style, requires that a retailer inventory and display a large number of different clip-on sunglasses. This leads to confusion on the part of the consumer as to how to select the best clip-on sunglasses for his or her frame style and activity. Hence, the consumer may require the assistance of a salesperson to help with the selection.

In order to overcome the need for sales assistance, I have invented a freestanding rotatable display rack capable of retaining a large number of different specialized clip-on sun-glasses. The rack assists the consumer in selecting the appropriate clip-on sunglasses for his or her frame style and activity, quickly and easly, without the need of a salesperson.

In general, I achieve this by providing a freestanding, rotatable multi-sided display rack. Each side of the rack has a first section and a plurality of second sections. Each first section displays a frame style indicia. The indicia may be a graphic depicting a pair of eyeglasses with a particular frame style, for example, aviator. Each second section displays a lens type indicia, for example a word designating a particular activity or a graphic depicting the activity. It also has a retainer for holding a plurality of clip-on sunglasses with a lens type fabricated for that activity. The clip-on sunglasses retained each side of the rack are adapted for use with the frame style depicted on the first section of that side.

To make a selection, a consumer determines his or her frame style and rotates the rack to located the side with a first section having indicia corresponding to that frame style. The customer then examines the second sections on the selected side, each of which retains a plurality of clip-ons for the selected frame style, suitable for a different activity such as, driving, water sports, etc., as represented by the lens type indicia. By locating the appropriate lens type indicia on the selected side, the consumer obtains the clip-on sunglasses from the corresponding retainer. In this way, clip-on sunglasses for the particular frame style and activity can be easily located, without assistance.

It is, therefore, a prime object of the present invention to provide a self-service display rack for clip-on sunglasses.

It is another object of the present invention to provide a self-service display rack for clip-on sunglasses grouped by frame style, suitable for different activities.

It is another object of the present invention to provide a display rack for clip-on sunglasses which permits consumers to select the appropriate clip-on for their needs, without assistance from sales personnel.

In accordance with the present invention, apparatus is provided for displaying a plurality of clip-on sunglasses having different sunglasses lens types, for use with one of a plurality of different eyeglasses frame styles. The apparatus comprises multi-side rack means. Each side of the rack means includes a first section and a plurality of second sections. Each of the first sections is associated with an eyeglass frame style indicia. Each of the second sections is associated with a different sunglass lens type indicia. Means are associated with for each of the second sections for retaining one or more clip-on sunglasses having a lens type corresponding to the sunglass lens type indicia of that second section. The retaining means of each of the second sections on a given side of the rack means retains clip-on sunglasses adapted for use with the eyeglass frame style indicated by the eyeglass frame style indicia of the first section of that side.

The rack means is preferrably freestanding. Preferably, it includes a base and means for mounting the rack means on the base. The mounting means preferrably includes means for rotatably mounting the rack means on the said base.

To these and to such other objects which may hereinafter appear, the present invention relates to a self-service display rack for clip-on sunglasses, as set forth in detail in the following specification and recited in the annexed claims, taken together with the accompanying drawings, wherein like numerals refer to like parts and in which:

Figure 1:
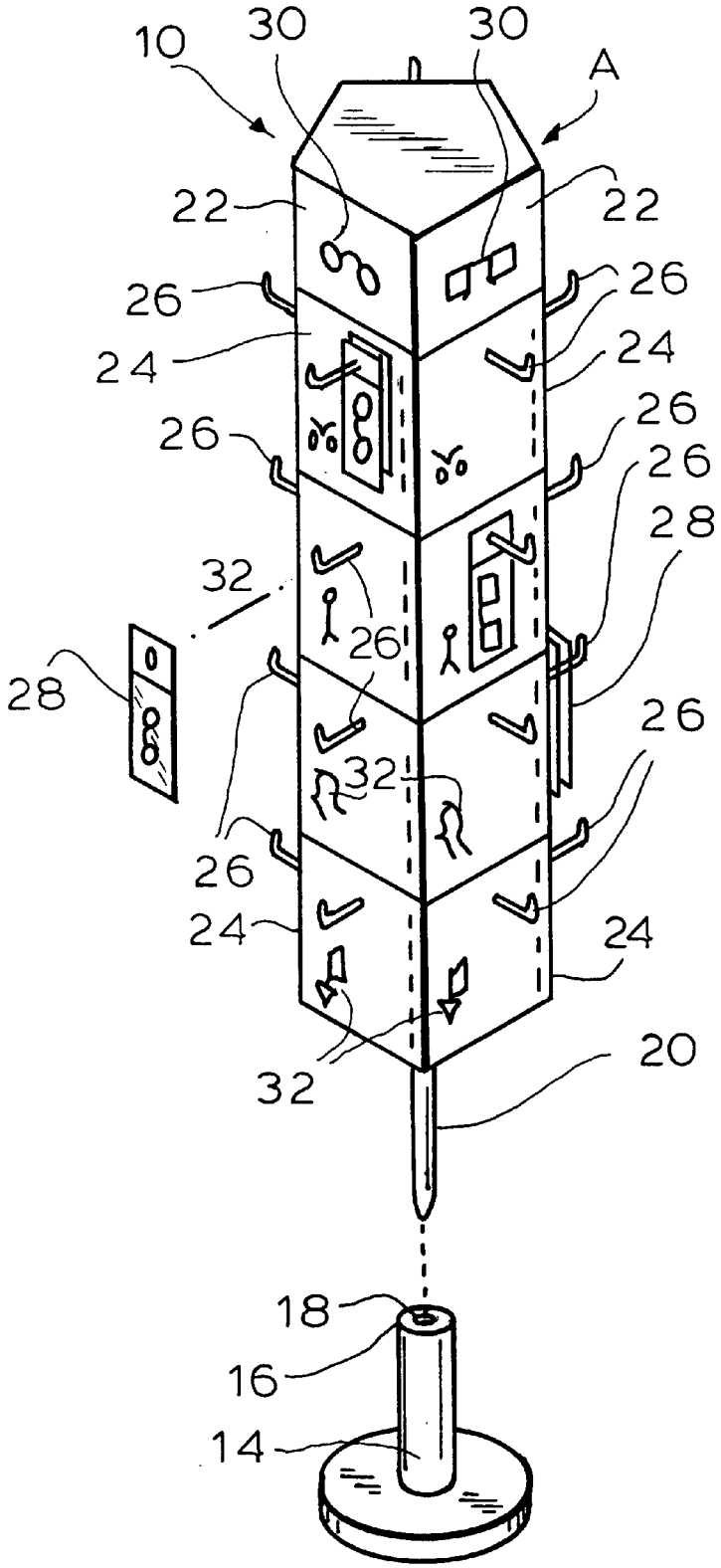
FIG. 1 is an exploded isometric view of the display rack of the present invention.
Figure 2:
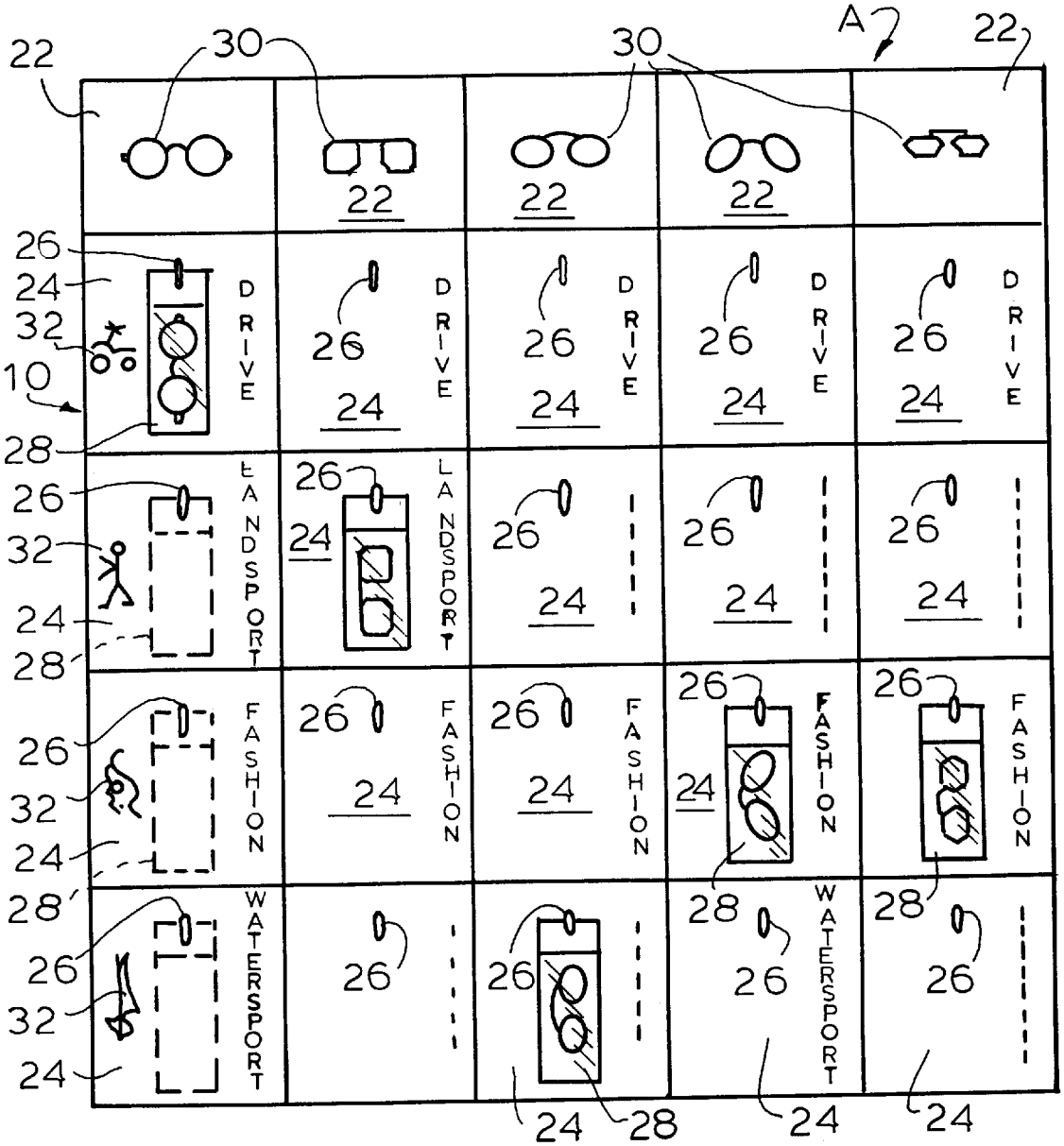
FIG. 2 is an expanded plan view of typical sides of the display rack of the present invention.

As seen in the drawings, the preferred embodiment of the display rack of the present invention, generally designated A, includes a five sided, freestanding body 10 mounted on a base 12. The top 14 of base 12 defines a bearing collar 16 with an opening 18. Extending from the underside of body 10 is a shaft 20 adapted to be received within opening 18 of collar 16 such that body 10 may be rotated relative to base 12 manually or by a motor (not shown) situated within the base.

Each side of body 10 has a top section 22 and several (four are illustrated) other sections 24. Each section 24 is provided with an outwardly extending rod 26 adapted to retain a plurality of clip-on sunglasses attached to hooks, or as illustrated, which are situated in blister packs 28 with a header with rod receiving opening.

Each top section 22 of each side corresponds to a different frame style and contains an indicia 30, such as a graphic depicting that frame style. Each of the sections 24 contain indicia designating an activity, such as a word and/or a graphic 32 depicting the activity, corresponding to the lens type suitable for that activity. The rod 26 associated with the section 24 retains clip-on sunglasses suitable for that activity.

To select the desired clip-on sunglasses, the customer rotates body 10 until he or she locates the side with the top section having indicia corresponding to his or her eyeglass frame type. The consumer then scans down the selected side until he or she finds the section 24 with the indicia for the activity of interest. The consumer then obtains the clip-on sunglasses from the rod extending from the selected activity section on the selected side. That clip-on will have the appropriate lens type for the activity of interst and is designed to fit the frame style of the consumer.

The selection process can be further facilitated by color-coding the activity sections. For example, all sections 24 with clip-ons having a lens type suitable for driving could be white, for landsports could be red, for watersports could be blue, etc. The headers for the blister packs 28 could be correspondingly colored for easy identification.

It will now be appreciated that the present application relates to a self-service display rack for clip-on sunglasses which assists consumers in selecting the clip-on sunglasses appropriate for their frame style and activity without the help of a sales person.

While only a single preferred embodiment of the present invention is disclosed for purposes of illustration, it is obvious that many variations and modifications could be made thereto. It is intended to cover all of these variations and modifications which fall within the scope of the present invention, as defined by the following claims.

I claim:

1. Apparatus for displaying a plurality of clip-on sunglasses having different lens types, for use with one of a plurality of different eyeglass frame styles, the apparatus comprising multi-sided rack means, each side of said rack means comprising a first section and a plurality of second sections, each of said first sections being associated with an eyeglass frame style indicia and each of said second sections being associated with a different lens type indicia and means associated with each of said second sections for retaining one or more clip-on sunglasses having the lens type corresponding to said lens type indicia of said second section, said retaining means associated with each of said second sections on a given side of said rack means retaining clip-on sunglasses adapted for use with the eyeglass frame style of said eyeglasses frame style indicia of said first section of said given side.

2. The apparatus of claim 1 wherein said rack means is freestanding.

3. The apparatus of claim 1 further comprising a base and means for mounting said rack means on said base.

4. The apparatus of claim 3 wherein said mounting means comprises means for rotatably mounting said rack means on said base.

* * * * *